US010492005B1

(12) United States Patent
Lorenz et al.

(10) Patent No.: US 10,492,005 B1
(45) Date of Patent: Nov. 26, 2019

(54) HIGH-EFFICIENCY SPEAKER WITH MULTI-MAGNET STRUCTURE

(71) Applicant: Microsoft Technology Licensing, LLC, Redmond, WA (US)

(72) Inventors: Christian Lorenz, Waterloo (CA); Christopher Michael Forrester, Kirkland, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/987,440

(22) Filed: May 23, 2018

(51) Int. Cl.

| | |
|---|---|
| ***H04R 9/02*** | (2006.01) |
| ***H04R 7/16*** | (2006.01) |
| ***H04R 9/06*** | (2006.01) |
| ***H04R 9/04*** | (2006.01) |

(52) U.S. Cl.
CPC ..... *H04R 9/025* (2013.01); *H04R 7/16* (2013.01); *H04R 9/043* (2013.01); *H04R 9/06* (2013.01)

(58) Field of Classification Search
CPC ... H04R 9/02; H04R 9/04; H04R 9/06; H04R 7/16
USPC ..... 381/398, 412, 596, 397, 400
See application file for complete search history.

(56) References Cited

U.S. PATENT DOCUMENTS

| | | | | |
|---|---|---|---|---|
| 4,327,257 | A | 4/1982 | Schwartz | |
| 6,865,282 | B2 | 3/2005 | Weisman | |
| 8,542,865 | B2 | 9/2013 | O'Neill | |
| 8,630,441 | B2 | 1/2014 | Shi et al. | |
| 8,649,550 | B2 | 2/2014 | Shi et al. | |
| 8,934,657 | B2 | 1/2015 | Wilk | |
| 9,113,258 | B2 | 8/2015 | Liu et al. | |
| 9,467,783 | B2 | 10/2016 | Bullimore | |
| 2006/0050922 | A1* | 3/2006 | Tomoeda | H04R 9/02 381/412 |
| 2007/0140522 | A1* | 6/2007 | Stewart | H04R 9/022 381/421 |
| 2008/0205688 | A1 | 4/2008 | Sato | |
| 2010/0104127 | A1 | 4/2010 | Cobb | |
| 2013/0202149 | A1* | 8/2013 | Yoon | H04R 9/02 381/433 |
| 2015/0358736 | A1* | 12/2015 | Wang | H04R 9/025 381/412 |

FOREIGN PATENT DOCUMENTS

| | | | |
|---|---|---|---|
| CN | 101321409 | A | 12/2008 |
| WO | 9854924 | A3 | 10/1999 |

OTHER PUBLICATIONS

"International Search Report and Written Opinion Issued in PCT Patent Application No. PCT/US2019/030987", dated Jul. 19, 2019, 9 Pages.

* cited by examiner

*Primary Examiner* — Melur Ramakrishnaiah
(74) *Attorney, Agent, or Firm* — Holzer Patel Drennan

(57) ABSTRACT

A speaker includes a multi-magnet structure including at least an inner magnet and an outer magnet. A voice coil is suspended from a membrane into a gap between the inner magnet and the outer magnet, and a spider is attached to the membrane and suspended at least partially by the inner magnet. The spider is configured to stabilize the membrane throughout a range of movement responsive to a force generated by the voice coil and the multi-magnet structure.

20 Claims, 6 Drawing Sheets

HIGH-EFFICIENCY SPEAKER WITH MULTI-MAGNET STRUCTURE

BACKGROUND

Within a speaker, pulses of electricity are typically passed through a voice coil positioned in proximity of a permanent magnet. As the magnetic field generated by the voice coil rapidly changes along with received current pulses of varying magnitude, the voice coil is attracted to and repelled from the permanent magnet. These vibrations of the voice coil are amplified by the motion of a speaker membrane that moves in and out to pump sound waves into the air. In general, speaker volume is proportional to the excursion range of the speaker membrane, and sound quality is impacted by the evenness of movement of the speaker membrane toward and away from the magnet. Rigid movement—like a piston—tends to provide higher sound quality while movement that is less even (e.g., wobbling due to poor membrane suspension) reduces sound quality.

In traditional large speakers, a flexible, corrugated support called a spider is used to suspend the voice coil in place within a basket housing. In a different variant, the spider can attach to the membrane (e.g., diaphragm) on one side and a basket or magnet on the other side, providing stabilization for the membrane throughout its corresponding range of motion. In contrast to these traditional large speakers, modern mini and micro speakers tend to feature thinner membranes that better respond to the flux ranges of smaller magnets. Often, the compact arrangement of mini and micro speakers does not permit a spider to be included to stabilize the membrane because, in many cases, the traditional location of the spider is occupied by magnet material as a result of spacing constraints.

SUMMARY

Implementations disclosed herein provide a high-efficiency speaker with a multi-magnet structure including at least an inner magnet and an outer magnet. A voice coil is suspended from a membrane into a gap between the inner magnet and the outer magnet, and a spider is attached to the membrane and suspended at least partially by the inner magnet. The spider stabilizes the membrane throughout a range of motion occurring responsive to forces generated by the voice coil and the multi-magnet structure.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

BRIEF DESCRIPTIONS OF THE DRAWINGS

DETAILED DESCRIPTIONS

The following disclosure provides multiple high-efficiency multi-magnet speaker designs. Although these designs may be implemented in speakers of any size, the disclosed designs may be particularly useful in addressing the design shortcomings of modern mini speakers.

In some mini speaker designs, a voice coil is wound around a permanent magnet as a space-saving measure; however, this design places the permanent magnet in the location where a spider may traditionally be included (e.g., in traditional large speaker designs) to stabilize a center of the membrane relative to the voice coil. Since the center of the membrane is not secured to a spider or to the voice coil, air pressure serves as a key source of stability for the membrane and additional structure may be included to prevent side-to-side membrane wobbling. More specifically, some mini speaker designs feature a plastic ring secured about an outer-perimeter of the membrane. However, a plastic ring adds weight, reducing speaker efficiency. To help maximize membrane excursion (and therefore volume), mini speakers may feature a thinner membrane that better responds to small Lorentz forces than the thicker membranes typically included in larger speakers. However, the use of a thinner membrane correlates with a drop in the sensitivity of the speaker and a drop in the overall output for a given input power. A common technique to counteract this is to use a larger amplifier to drive the speaker and materials that have better thermal capabilities to handle an increase in voice coil temperature that occurs as a result of the increased amplification. However, larger amplifiers draw increased power, which can be problematic in battery-operated speakers that may, as a result, require recharge sooner.

The herein disclosed technology provides an increase in speaker efficiency that may permit mini speakers to be driven with smaller amplifiers without a trade-off in volume or sound quality. This increased efficiency may translate to better sound and/or decreased power consumption as compared to similar-sized speakers that include larger amplifiers and/or speakers that do not utilize a spider to stabilize the membrane.

Figure 1A:
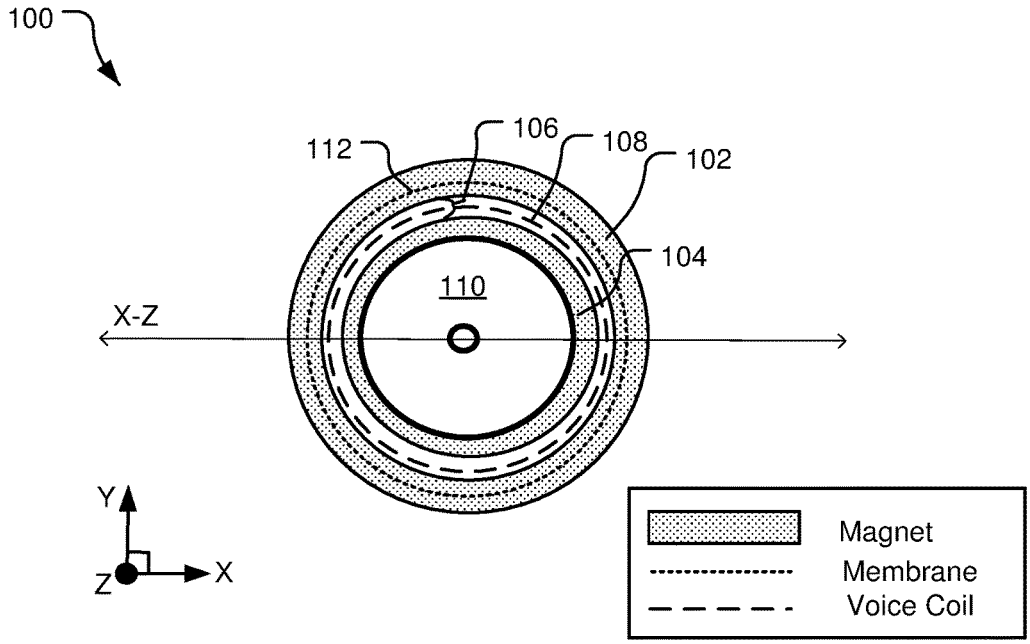
FIG. 1A illustrates a top-down view of an example multi-magnet speaker.
Figure 1B:
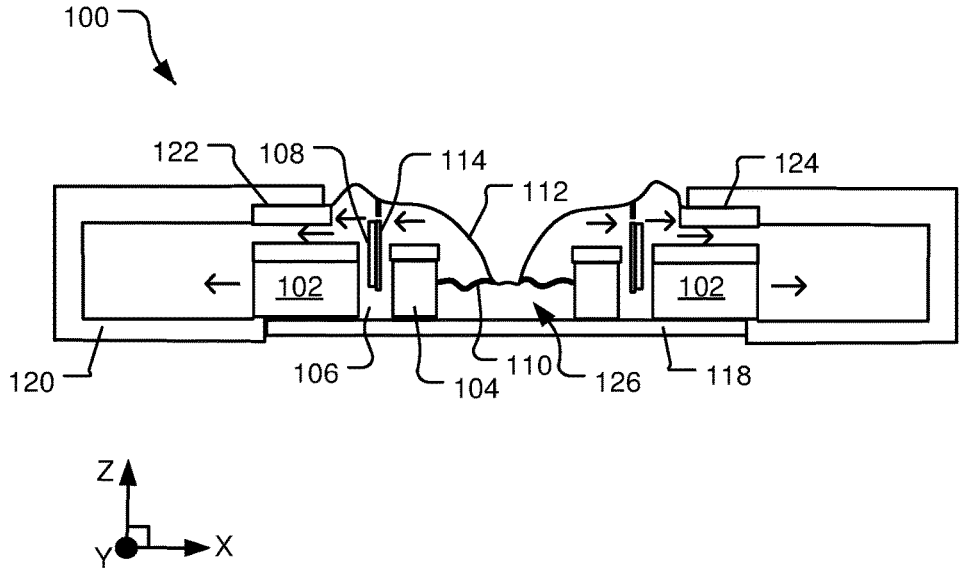
FIG. 1B illustrates a cross-sectional view of the multi-magnet speaker of FIG. 1A.

FIGS. 1A and 1B represent different views of an example multi-magnet speaker 100. FIG. 1A is a top-down view of the multi-magnet speaker 100, which includes two annular-shaped magnets. An inner magnet 104 is arranged within an aperture of the outer magnet 102. The outer magnet 102 and the inner magnet 104 are arranged on a bottom plate 118 (shown in FIG. 1B), and the magnets 102, 104 are sized and spaced such that there exists a gap 106 between the outer magnet 102 and the inner magnet 104. A voice coil 108 is positioned within the gap 106 and is positioned to coil one or multiple times about the inner magnet 104 (around the Z-axis perpendicular to the page).

The multi-magnet speaker 100 includes a spider 110 suspended within an aperture of the inner magnet 104. The top-down view of FIG. 1A illustrates an outer perimeter of a membrane 112, which is shown transparent so as to permit visibility of the underlying components—e.g., the spider 110, the inner magnet 104, the gap 106, and an inner portion of the outer magnet 102. For clarity of illustration, aspects of a housing (visible as housing 120 in FIG. 1B) are not shown in FIG. 1A.

FIG. 1B illustrates a cross-sectional view of the multi-magnet speaker 100 of FIG. 1A taken along the X-Z plane. This view shows several additional features not visible in FIG. 1A. The inner magnet 104 and the outer magnet 102 are shown arranged on the bottom plate 118, which is attached to a housing 120. The voice coil 108 is secured to the membrane 112 by a bobbin 114 and suspended by the bobbin 114 and membrane 112 within the gap 106 between the inner magnet 104 and the outer magnet 102. The membrane 112 has an outer perimeter secured to a basket 122 (e.g., an annular basket), which is attached to the housing 120. A central portion of the membrane 112 is attached to a central portion of the spider 110 (e.g., via adhesive), and the spider 110 is itself suspended above the bottom plate 118 within an aperture of the inner magnet 104. This suspension of the spider 110 within the inner magnet 104 may be achieved in a variety of different ways such as by utilizing an adhesive to attach the spider 110 directly to a sidewall of the inner magnet 104 or by using an interim layer that provides a stable adhesive surface, such as a by applying adhesive to a thin, plastic-like holder that is bonded to a sidewall of the inner magnet 104 and the perimeter of the spider 110.

The top plate 124 (shown in FIG. 1B but not in FIG. 1A) includes two pieces—one sized and shaped to cover the inner magnet 104 and one sized and shaped to cover the outer magnet 102. Gaps between the pieces of the top plate 124 vertically align—along the Z-axis—with the gap 106, which receives the voice coil 108. Additionally, the gaps between the pieces of the top plate 124 also vertically align with the spider 110. In one implementation, the inner magnet 104 and the outer magnet 102 are made from ferrite or powerful neodymium, while the top plate 124 and the bottom plate 118 are made from soft iron.

This multi-magnet design provides enhanced air flow as compared to single-magnet speakers. Various arrows in FIG. 1B indicate available ventilation paths between the membrane 112, inner magnet 104, outer magnet 102, and housing 120. (Note: the bobbin 114 is air-permeable). The enhanced air flow offered by this design provides greater sound pressure which translates to a large excursion range for the membrane 112 as compared to existing designs.

Further, the disclosed multi-magnet design makes it possible to include the spider 110 for membrane stabilization. The spider 110 is included in a central region 126 that is, in traditional mini speakers, occupied by magnetic material. The presently-disclosed design effectively displaces this magnetic material to an opposite side of the voice coil 108. The width of the gap 106 and corresponding proximity between the voice coil 108 and the two magnets 102,104 may vary in different implementations based on magnetic properties but is generally such as to ensure that the voice coil 108 is subjected to a sufficient amount of flux (e.g., identical flux as in single-magnet speaker designs) to cause vibrations of predetermined magnitude.

Figure 2A:
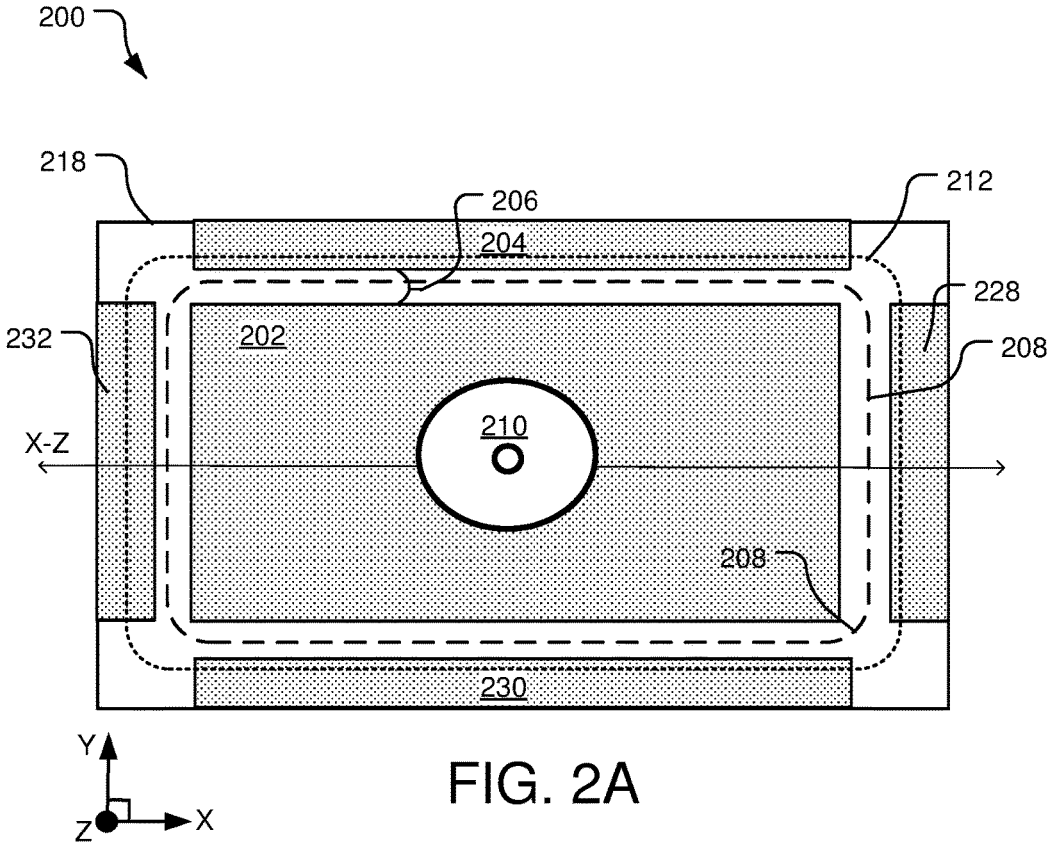
FIG. 2A illustrates a top-down view of another example multi-magnet speaker.
Figure 2B:
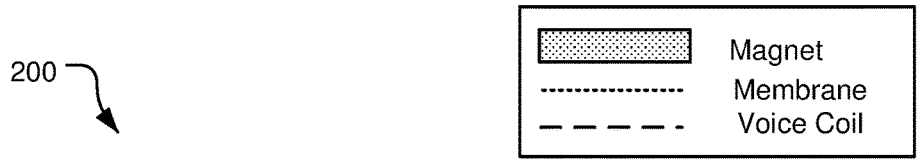
FIG. 2B illustrates a cross-sectional view of the multi-magnet speaker of FIG. 2A.
Figure 2B:
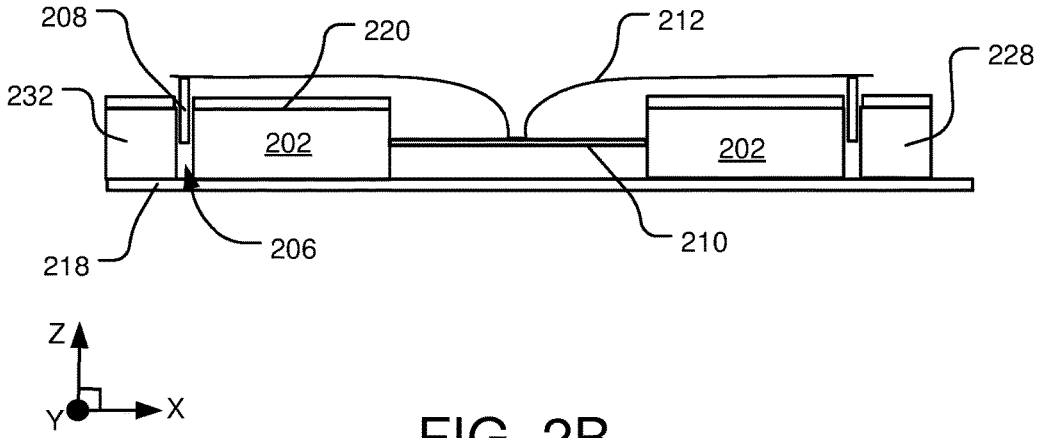

FIGS. 2A and 2B represent different views of a portion of another example multi-magnet speaker 200. As shown in top-down view FIG. 2A, the multi-magnet speaker 200 is generally rectangular in shape and includes five magnets. Four of the magnets are arranged external to a perimeter formed by a voice coil 208 and are therefore referred to as outer magnets 204, 228, 230, and 232. Each of the outer magnets 204, 228, 230, and 232 is arranged to be parallel with and proximal to a corresponding one of the four sides of a bottom plate 218. A fifth one of the magnets (e.g., 202) is arranged internal to the perimeter formed by the voice coil 208 is therefore referred to as the inner magnet 202.

The inner magnet 202 and the outer magnets 204, 228, 230, and 232 are arranged on the bottom plate 218 and sized and spaced such that there exists a gap 206 that forms a perimeter around the inner magnet 202 separating the inner magnet 202 from the outer magnets 204, 228, 230, and 232. The inner magnet 202 includes an annular-shaped cavity near its center, and a spider 210 is suspended by a side surface of the inner magnet 202 within the annular-shaped cavity.

The top-down view of FIG. 2A also illustrates an outer perimeter of a membrane 212; however, the membrane 212 is shown transparent so as to permit visibility of the underlying components—e.g., the spider 210, the inner magnet 202, the gap 206, and the outer magnets 204, 228, 230, and 232 (which each partially underlies the membrane 212). Although the multi-magnet speaker 200 may include a housing with properties the same or similar to those shown and described with respect to FIG. 1B (e.g., housing 120), the housing is not shown in either of FIG. 2A or 2B.

FIG. 2B illustrates a cross-sectional view of the multi-magnet speaker 200 of FIG. 2A taken along the X-Z plane. This view shows two of the outer magnets 228 and 232 on opposite sides of the inner magnet 202. The gap 206 separates the inner magnet 202 from the outer magnets 204, 228, 230, and 232, and the voice coil 208 is secured to the membrane 212 (e.g., by a bobbin or other mechanism) and suspended within the gap 206. In one implementation, the voice coil 208 coils about the Z-axis making multiple turns about the inner magnet 202.

As shown in FIG. 2B, the spider 210 is suspended above the bottom plate 218 by the inner magnet 202 and has a center that is secured to a central portion of the membrane 212.

The multi-magnet speaker 200 further includes a top plate 220 with multiple individual pieces. In one implementation, the top plate 220 has five individual pieces each sized and shaped to correspond to and vertically align with a corresponding one of the five magnets. Gaps between the individual pieces of the top plate 220 correspond to the gap 206 as well as the various gaps between the outer magnets 204, 228, 230, and 232. Notably, the inner magnet 202 has a larger x-direction thickness than the outer magnets 204, 228, 230, and 232. This is in contrast with FIG. 1, where the inner magnet 104 has a smaller x-direction thickness than the outer magnet 102. As illustrated by these figures, the relative sizes of the inner and outer magnets may differ depending on design constraints, motor strength needs, and cost concerns. In some implementations, the one or more outer magnets (e.g., outer magnets 204, 228, 230, and 232) are arranged around the perimeter of the bottom plate 218 (as shown), but in other cases this arrangement may extend beyond the perimeter of the bottom plate 218. This may, for example, be beneficial when a diameter of the speaker housing (not shown) is larger than the diameter of the bottom plate 218 (e.g., such as in an especially thin speaker design). Such a design may facilitate a reduction in the z-thickness of the speaker without compromising the strength of magnetic flux interacting with the voice coil 208.

Figure 3A:
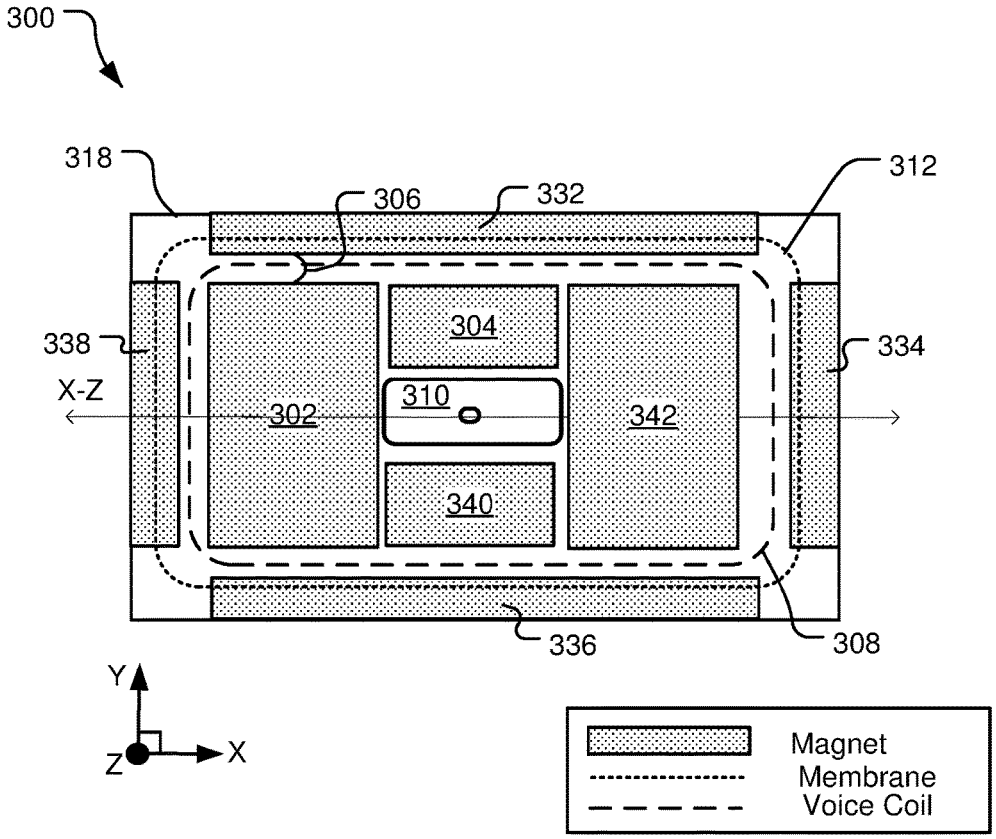
FIG. 3A illustrates a top-down view of another example multi-magnet speaker.
Figure 3B:
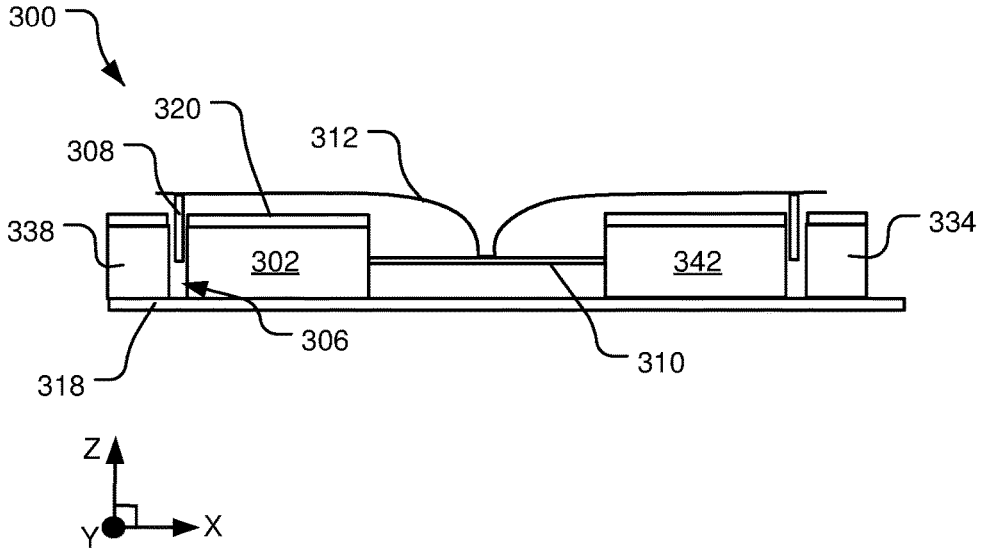
FIG. 3B illustrates a cross-sectional view of the multi-magnet speaker of FIG. 3A.

FIGS. 3A and 3B represent different views of a portion of another example multi-magnet speaker 300. As shown in top-down view FIG. 3A, the multi-magnet speaker 300 is generally rectangular and includes eight magnets (e.g., 302, 304, 332, 334, 336, 338, 340, and 342.) Four of the magnets are arranged external to a perimeter formed by a voice coil 308 and are therefore referred to as outer magnets 332, 334, 336, and 338. Each of the outer magnets 332, 334, 336, and 338 is arranged to be parallel with and proximal to a corresponding one of the four sides of a bottom plate 318. Four other magnets are internal to the perimeter formed by the voice coil 308 and are therefore referred to as inner magnets 302, 304, 340, and 342.

The inner magnets 302, 304, 340, and 342 and the outer 332, 334, 336, and 338 are arranged on the bottom plate 318 and sized and spaced such that there exists a gap 306 that forms a perimeter around the inner magnets 302, 304, 340, and 342 that separates the inner magnets 302, 304, 340, and 342 from the outer magnets 332, 334, 336, and 338. The inner magnets 302, 304, 340, and 342 are arranged to leave a rectangular cavity in a central portion of the multi-magnetic speaker 300, and a spider 310 is suspended in this cavity between side surfaces of the inner magnets 302, 304, 340, and 342.

The top-down view of FIG. 3A also illustrates an outer perimeter of a membrane 312, which is shown transparent so as to permit visibility of the underlying components. Although the multi-magnet speaker 300 may include a housing with properties the same or similar to those shown and described with respect to FIG. 1B (e.g., housing 120), the housing is not shown in either of FIG. 3A or 3B.

FIG. 3B illustrates a cross-sectional view of the multi-magnet speaker 300 of FIG. 3A taken along the X-Z plane. This view shows two of the outer magnets 334 and 338 on opposite sides of the inner magnets 302 and 342. The voice coil 308 is secured to the membrane 312 (e.g., by a bobbin or other mechanism) and suspended within the gap 306, while the spider 310 is suspended above the bottom plate 318 by side surface of the inner magnets 302 and 342 (and also by side surface of the inner magnets 304 and 340 as shown in FIG. 3A). The spider 310 has a center that is secured to a central portion of the membrane 312.

The multi-magnet speaker 300 further includes a top plate 320 with multiple individual pieces. In one implementation, the top plate 320 has five individual pieces. One of the pieces is sized and shaped to cover the inner magnets 302, 304, 340, and 342, while the remaining four pieces are each sized and shaped to cover a corresponding one of the outer magnets 332, 334, 336, and 338. Gaps between the individual pieces of the top plate 320 correspond to the gap 306 as well as the various gaps between the outer magnets 332, 334, 336, and 338.

Figure 4A:
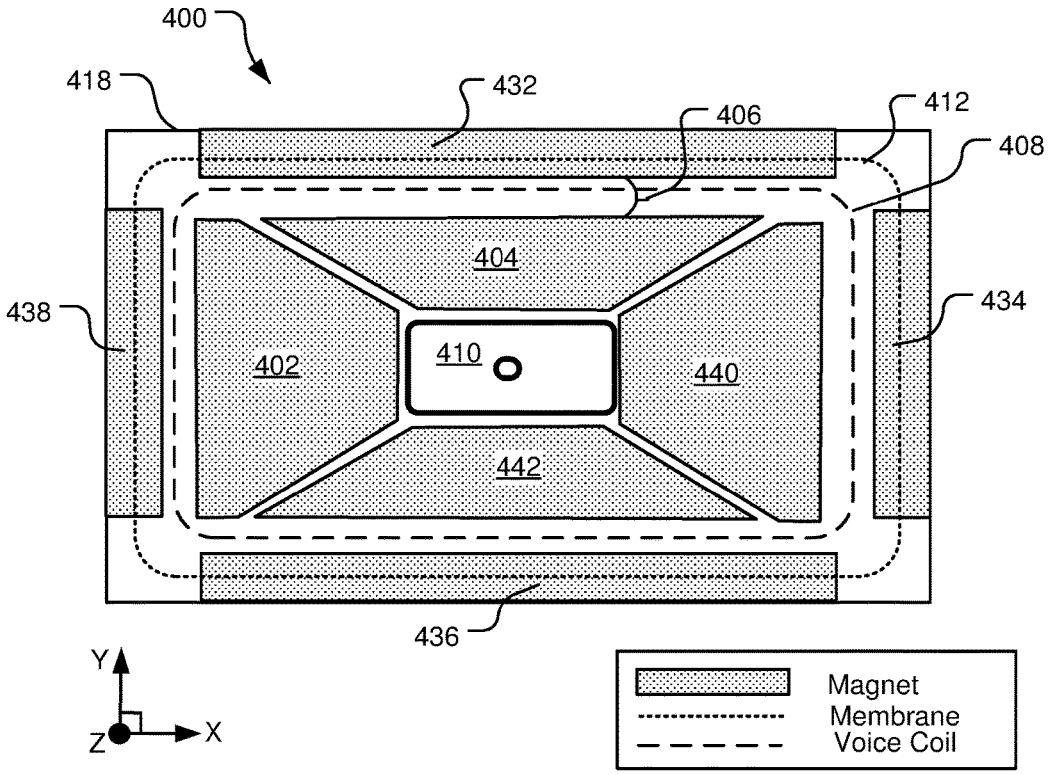
FIG. 4A illustrates a top-down view of another example multi-magnet speaker.

FIG. 4A represents a top-down view of a portion of still another example multi-magnet speaker 400. The multi-magnet speaker 400 includes a multi-magnet structure formed by four inner magnets 402, 404, 440, and 442 and four outer magnets 432, 434, 436, and 438 arranged on a bottom plate 418. The inner magnets and outer magnets are arranged on opposite sides of a voice coil 408, which is suspended from a membrane 412 (shown transparent to permit visibility of underlying components) within a gap 406 between the inner magnets 402, 404, 440, and 442 and the outer magnets 432, 434, 436, and 438.

The inner magnets 402, 404, 440, and 442 are arranged to form a rectangular cavity in a central portion of the multi-magnetic speaker 400, and a spider 410 is suspended in the cavity by side surfaces of the inner magnets 402, 404, 440, and 442. The membrane 412 has a center that is secured to a center of the spider 410. Although the multi-magnet speaker 400 may include a housing with properties the same or similar to those shown and described with respect to FIG. 1B (e.g., housing 120), the housing is not shown in either of FIG. 4A or 4B.

Figure 4B:
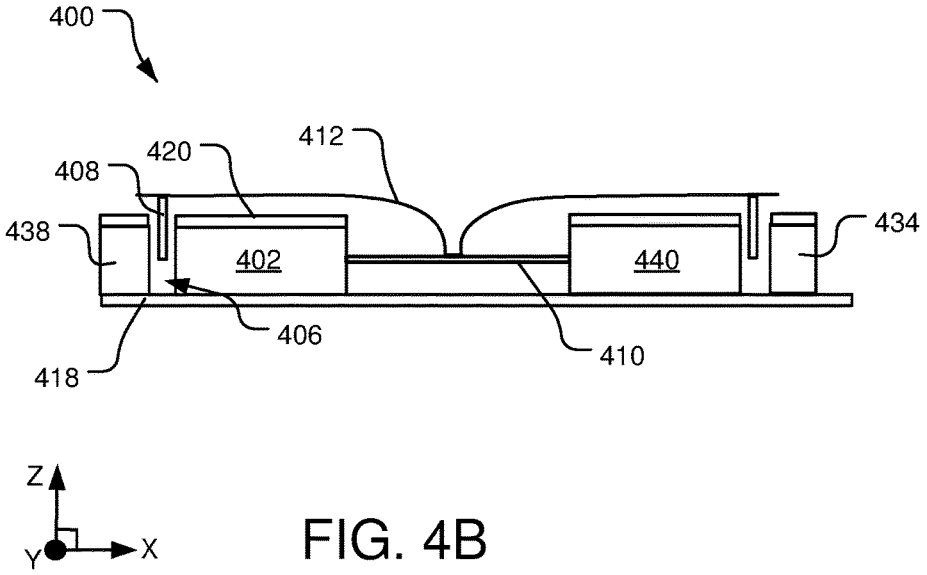
FIG. 4B illustrates a cross-sectional view of the multi-magnet speaker of FIG. 4A.

FIG. 4B represents a cross-sectional view of the multi-magnet speaker 400 of FIG. 4A taken along the X-Z plane. Features of FIG. 4B not described explicitly herein may be the same or similar to those described above with respect to FIG. 3B.

Figure 5A:
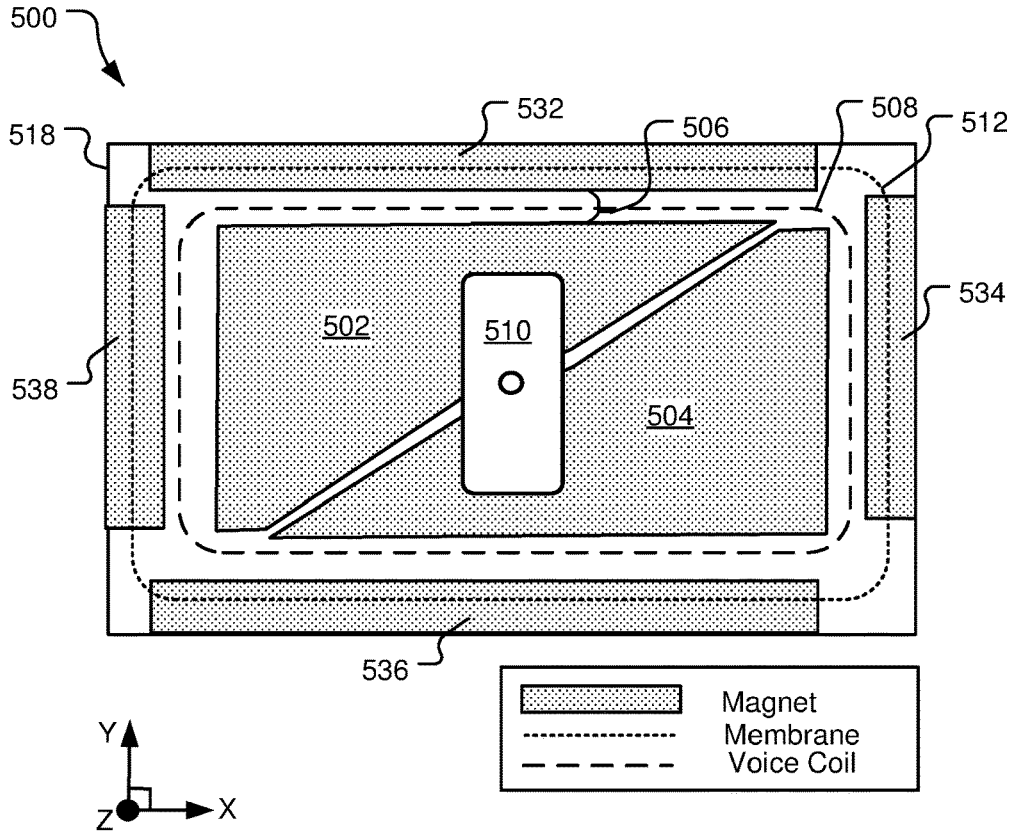
FIG. 5A illustrates a top-down view of another example multi-magnet speaker.

FIG. 5A represents a top-down view of a portion of yet another example multi-magnet speaker 500. The multi-magnet speaker 500 includes a multi-magnet structure formed by two inner magnets 502 and 504 and four outer magnets 532, 534, 536, and 538 arranged on a bottom plate 518. The inner magnets 502 and 504 are shown to be trapezoidal; but are, in another implementation, triangular. The four outer magnets 532, 534, 536, and 538 are rectangular. The inner magnets 502 and 504 and outer magnets 532, 534, 536, and 538 are arranged on opposite sides of a voice coil 508, which is suspended from a membrane 512 (shown transparent to permit visibility of underlying components) within a gap 506 between the inner magnets 502, 504 and the outer magnets 532, 534, 536, and 538. The membrane 512 has a center that is secured to a center of a spider 510, which is itself suspended by sidewalls of the inner magnets 502 and 504.

Figure 5B:
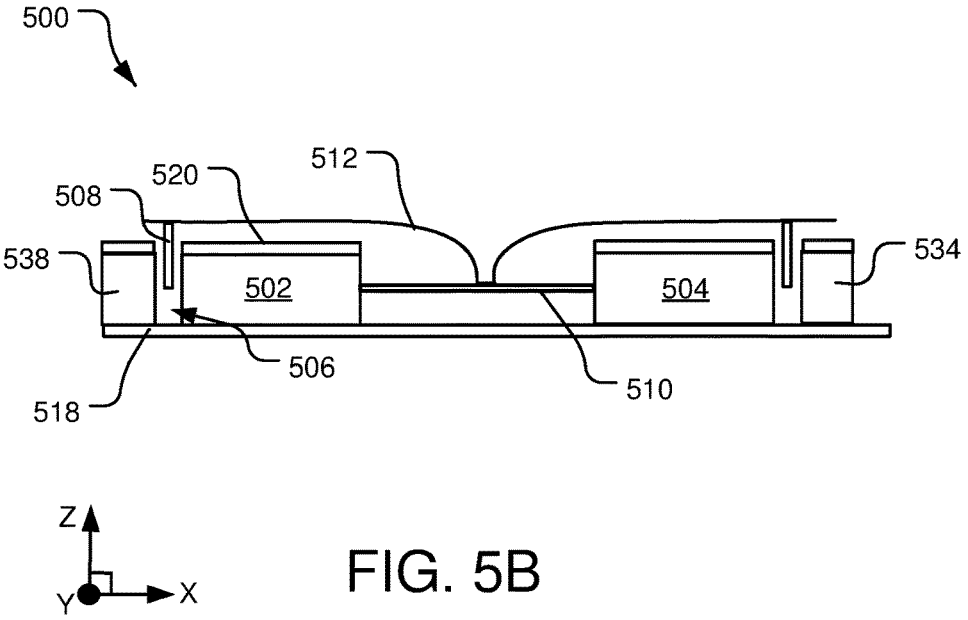
FIG. 5B illustrates a cross-sectional view of the multi-magnet speaker of FIG. 5A.

FIG. 5B represents a cross-sectional view of the multi-magnet speaker 500 of FIG. 5A taken along the X-Z plane. Features of FIG. 5B not described explicitly herein may be the same or similar to those described above with respect to FIG. 3B. The same or similar technology leveraged in the designs of FIGS. 1-5 may be implemented in a number of different multi-magnet speaker designs other than those specific designs disclosed herein, including designs with a greater number of magnets and/or differently-shaped magnets than those exemplary designs disclosed herein.

Figure 6:
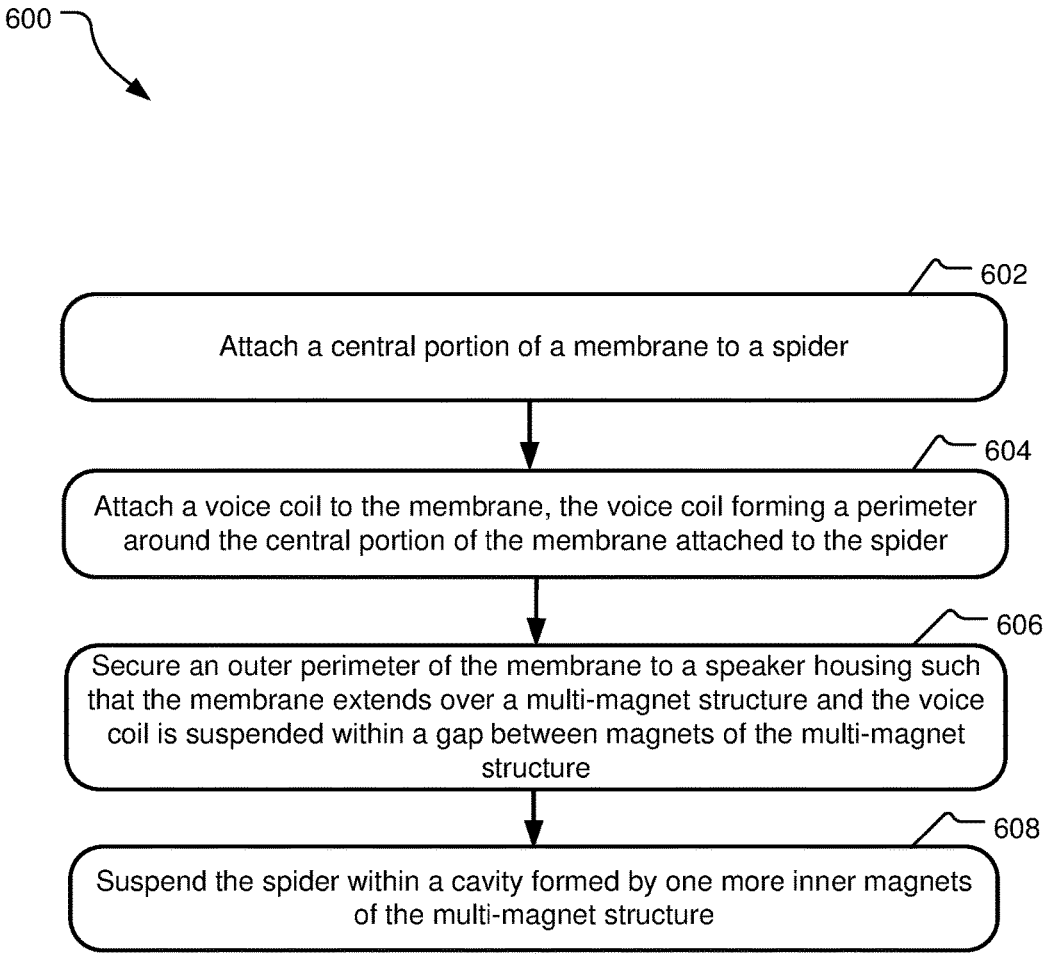
FIG. 6 illustrates example operations for assembling a multi-magnet speaker.

FIG. 6 illustrates example operations 600 for assembling a multi-magnet speaker. A first attachment operation 602 attaches a central portion of a membrane to a spider. When the membrane and spider are integrated within a speaker, the spider serves the function of stabilizing the membrane toward and away from a multi-magnet structure as the membrane moves under force generated by a multi-magnet structure and a voice coil.

Another attachment operation 604 attaches a voice coil to the membrane such that the voice coil forms a perimeter around the central portion of the membrane attached to the spider. A securing operation 606 secures an outer perimeter of the membrane to a speaker housing. When the outer perimeter is secured, that the membrane extends over a multi-magnet structure and the voice coil is suspended within a gap between magnets of the multi-magnet structure. A suspension operation 608 suspends the spider within a cavity formed by one or more inner magnets of the multi-magnet structure.

An example speaker disclosed herein includes a multi-magnet structure including at least an inner magnet and an outer magnet, a voice coil suspended from a membrane into a gap formed between the inner magnet and the outer magnet; and a spider attached to the membrane and suspended at least partially by the inner magnet. The spider is configured to stabilize the membrane throughout a range of movement occurring in response to forces generated by the voice coil and the multi-magnet structure.

Another example speaker according to any preceding speaker includes a spider suspended within an aperture of the inner magnet.

In another example speaker of any preceding speaker, the multi-magnet structure comprises multiple outer magnets positioned at locations external to a perimeter of the voice coil and the inner magnet is positioned internal to the perimeter of the voice coil.

In yet another example speaker of any preceding speaker, the multi-magnet structure comprises multiple outer magnets and multiple inner magnets. The multiple outer magnets are positioned at locations external to a perimeter of the voice coil and the multiple inner magnets are positioned at locations internal to a perimeter of the voice coil.

In still another example speaker of any preceding speaker, the voice coil is suspended in the gap that separates the multiple inner magnets from the multiple outer magnets.

In yet another example speaker of any preceding speaker, the spider is suspended by the multiple inner magnets.

In still another example speaker of any preceding speaker, the outer magnet has a greater cross-sectional thickness than the inner magnet along an axis perpendicular to an axis of motion for the membrane.

In yet another example speaker of any preceding speaker, the membrane completely overlaps the inner magnet.

In still another example speaker of any preceding speaker, the membrane overlaps an inner portion of the outer magnet but does not overlap an outer portion of the outer magnet.

In another example speaker of any preceding speaker, the inner magnet rests within an aperture of the outer magnet.

An example method disclosed herein includes suspending a voice coil from a membrane and into a gap of a multi-magnet structure and suspending a spider against at least one wall of the at least one inner magnet. The gap of the multi-magnet structure is formed between at least one inner magnet and least one outer magnet, and the spider is attached to the membrane and configured to stabilize the membrane throughout a range of movement occurring in response to forces generated by the voice coil and the multi-magnet structure.

In another example method according to any preceding method, the spider is suspended within an aperture formed within the at least one inner magnet.

In yet another example method according to any preceding method, the multi-magnet structure comprises multiple outer magnets positioned at locations external to a perimeter of the voice coil, and the inner magnet is positioned internal to the perimeter of the voice coil.

In yet still another example method according to any preceding method, the multi-magnet structure comprises multiple outer magnets and multiple inner magnets. The multiple outer magnets are positioned at locations external to a perimeter of the voice coil and the multiple inner magnets are positioned at locations internal to a perimeter of the voice coil.

In another example method according to any preceding method, the gap separates the multiple inner magnets from the multiple outer magnets.

In still another example method according to any preceding method, the spider is suspended by the multiple inner magnets.

In yet still another example method of any preceding method, the spider attaches to a central portion of the membrane.

In still another example method of any preceding method, the membrane completely overlaps the inner magnet.

In yet still another example method of any preceding method, the membrane overlaps an inner portion of the outer magnet but does not overlap an outer portion of the outer magnet.

An example device disclosed herein includes a multi-magnet structure including outer magnets and at least one inner magnet and a voice coil attached to a membrane and suspended in a gap between the outer magnets and the at least one inner magnet. The At least one inner magnet is internal to the voice coil and the outer magnets are external to the voice coil, and the device further includes a spider suspended by the at least one inner magnet and attached to a membrane configured to move toward and away from the multi-magnet structure under a force generated by the voice coil and the multi-magnet structure.

An example system disclosed herein includes a means for suspending a voice coil from a membrane and into a gap of a multi-magnet structure and a means for suspending a spider against at least one wall of the at least one inner magnet. The gap of the multi-magnet structure is formed between at least one inner magnet and least one outer magnet, and the spider is attached to the membrane and configured to stabilize the membrane throughout a range of movement occurring in response to forces generated by the voice coil and the multi-magnet structure.

The implementations described herein are implemented as logical steps in one or more computer systems. The logical operations may be implemented (1) as a sequence of processor-implemented steps executing in one or more computer systems and (2) as interconnected machine or circuit modules within one or more computer systems. The implementation is a matter of choice, dependent on the performance requirements of the computer system being utilized. Accordingly, the logical operations making up the implementations described herein are referred to variously as operations, steps, objects, or modules. Furthermore, it should be understood that logical operations may be performed in any order, unless explicitly claimed otherwise or a specific order is inherently necessitated by the claim language.

What is claimed is:

1. A speaker comprising:

a multi-magnet structure including at least an inner magnet and an outer magnet;

a voice coil suspended from a membrane into a gap formed between the inner magnet and the outer magnet; and a spider attached to the membrane and suspended at least partially by the inner magnet, the spider configured to stabilize the membrane throughout a range of movement occurring in response to forces generated by the voice coil and the multi-magnet structure.

2. The speaker of claim 1, where the spider is suspended within an aperture of the inner magnet.

3. The speaker of claim 1, wherein the multi-magnet structure comprises multiple outer magnets positioned at locations external to a perimeter of the voice coil, the inner magnet being positioned internal to the perimeter of the voice coil.

4. The speaker of claim 1, wherein the multi-magnet structure comprises multiple outer magnets and multiple inner magnets, the multiple outer magnets being positioned at locations external to a perimeter of the voice coil and the multiple inner magnets being positioned at locations internal to a perimeter of the voice coil.

5. The speaker of claim 4, wherein the voice coil is suspended in the gap that separates the multiple inner magnets from the multiple outer magnets.

6. The speaker of claim 4, wherein the spider is suspended by the multiple inner magnets.

7. The speaker of claim 1, wherein the outer magnet has a greater cross-sectional thickness than the inner magnet along an axis perpendicular to an axis of motion for the membrane.

8. The speaker of claim 1, wherein the membrane completely overlaps the inner magnet.

9. The speaker of claim 1, wherein the membrane overlaps an inner portion of the outer magnet but does not overlap an outer portion of the outer magnet.

10. The speaker of claim 1, wherein the inner magnet rests within an aperture of the outer magnet.

11. A method comprising:

suspending a voice coil from a membrane and into a gap of a multi-magnet structure, the gap formed between at least one inner magnet and least one outer magnet; and suspending a spider against at least one wall of the at least one inner magnet, the spider attached to the membrane and configured to stabilize the membrane throughout a range of movement occurring in response to forces generated by the voice coil and the multi-magnet structure.

12. The method of claim 11, where the spider is suspended within an aperture formed within the at least one inner magnet.

13. The method of claim 11, wherein the multi-magnet structure comprises multiple outer magnets positioned at locations external to a perimeter of the voice coil, the inner magnet being positioned internal to the perimeter of the voice coil.

14. The method of claim 11, wherein the multi-magnet structure comprises multiple outer magnets and multiple inner magnets, the multiple outer magnets being positioned at locations external to a perimeter of the voice coil and the multiple inner magnets being positioned at locations internal to a perimeter of the voice coil.

15. The method of claim 14, wherein the gap separates the multiple inner magnets from the multiple outer magnets.

16. The method of claim 14, wherein the spider is suspended by the multiple inner magnets.

17. The method of claim 11, wherein the spider attaches to a central portion of the membrane.

18. The method of claim 11, wherein the membrane completely overlaps the inner magnet.

19. The method of claim 11 wherein the membrane overlaps an inner portion of the outer magnet but does not overlap an outer portion of the outer magnet.

20. A device comprising:

a multi-magnet structure including outer magnets and at least one inner magnet;

a voice coil attached to a membrane and suspended in a gap between the outer magnets and the at least one inner magnet, the at least one inner magnet being internal to the voice coil and the outer magnets being external to the voice coil;

a spider suspended by the at least one inner magnet and attached to a membrane configured to move toward and away from the multi-magnet structure under a force generated by the voice coil and the multi-magnet structure.

* * * * *